United States Patent [19]

Immordino

[11] 4,099,650

[45] Jul. 11, 1978

[54] CONVERTIBLE BLISTER-CARD PACKAGE

[75] Inventor: Vincent J. Immordino, Flushing, N.Y.

[73] Assignee: Display Originals, Inc., West Babylon, N.Y.

[21] Appl. No.: 762,055

[22] Filed: Jan. 24, 1977

[51] Int. Cl.[2] ..... B65G 59/06

[52] U.S. Cl. ..... 221/266; 229/17 B

[58] Field of Search ..... 221/266, 256; 229/17 B, 229/17 M, 7 SC; 206/45.21, 45.23, 45.25, 45.31, 45.33

[56] References Cited

U.S. PATENT DOCUMENTS

| | | | |
|---|---|---|---|
| 1,645,771 | 10/1927 | Pillsbury | 229/17 B |
| 2,067,749 | 1/1937 | Zimmerman et al. | 229/17 B X |
| 3,018,879 | 1/1962 | Crane, Jr. | 206/45.31 |
| 3,164,298 | 1/1965 | Repko | 229/17 B |

*Primary Examiner*—Stanley H. Tollberg
*Attorney, Agent, or Firm*—Michael Ebert

[57] ABSTRACT

A blister-card package for housing cylindrical articles of merchandise, the package being convertible into an easel-supported display stand and a one-at-a-time dispenser. The package is constituted by a card covered by a transparent plastic dome to define a rectangular container for a stack of cylinders, the container having an opening in the lower end thereof from which the articles may be withdrawn.

7 Claims, 16 Drawing Figures

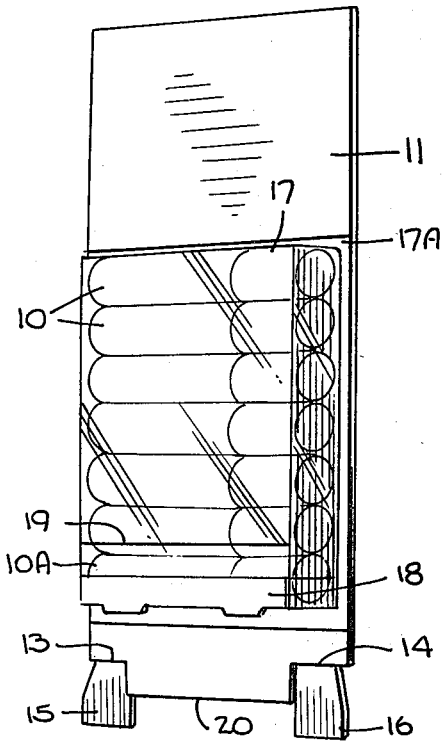
Fig. 1.
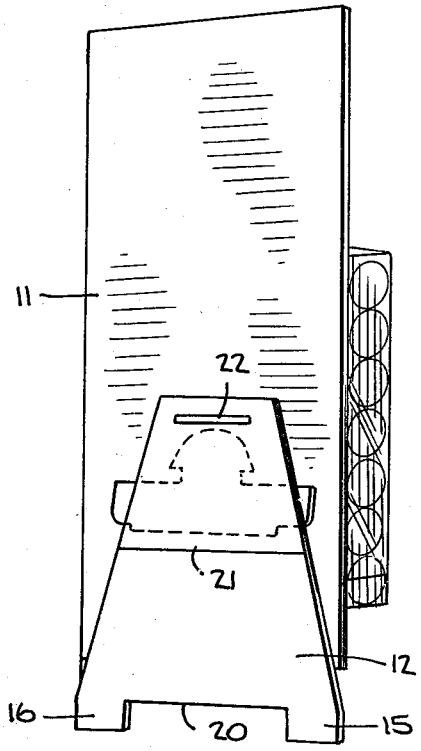
Fig. 2.
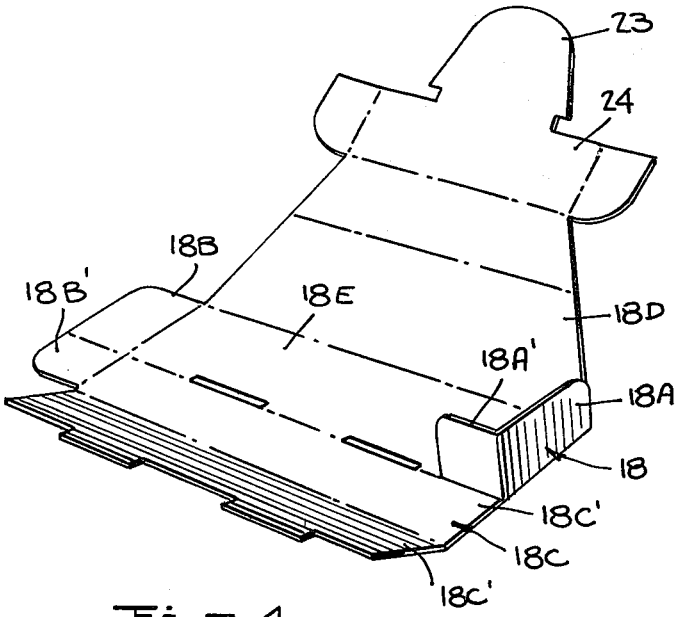
Fig. 4.
Fig. 3.
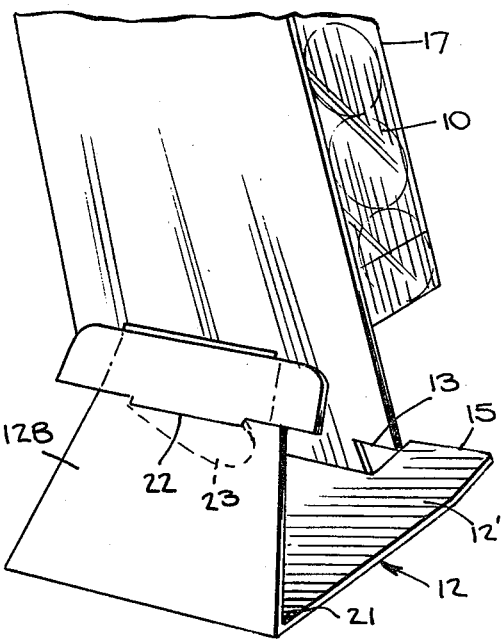

CONVERTIBLE BLISTER-CARD PACKAGE

BACKGROUND OF INVENTION

This invention relates generally to blister-card packaging, and more particularly to a blister-card package for cylindrical articles of merchandise, the package being convertible into an easel-supported display stand and a one-at-a-time article dispenser.

The traditional practice in packaging small items such as pen-light batteries, lipstick tubes, "Lifesaver" style candy mints and similar small articles of merchandise having a cylindrical or roll form is to contain a group thereof in a small sealed box. In many cases, the seal is simply a transparent plastic film wrapping. Since most customers wish to see an article before making a purchase, it is necessary to first break the seal and then uncover the box. Should the customer after seeing the merchandise then decide against making a purchase, the unsealed box must then be returned to the shelf.

This creates a problem; for the next customer who wishes to see the merchandise will be presented with an unsealed box, which may raise a question in his mind as to whether the merchandise is fresh or has been returned by a dissatisfied customer.

To overcome this problem, blister card packages have been developed in which a group of items is housed within a transparent thermo-plastic dome whose skirt is thermally sealed to a stiff cardboard base. The blister card makes it possible for the customer to see what he is buying without destroying the integrity of the package. The difficulty with a conventional blister card package is that in order to withdraw one or more of the items held therein, it is necessary to cut an access hole in the card.

Most cards in blister-card packages are provided with a perforated zone making it possible to punch an access hole therein. However, one cannot readily withdraw the items through this hole, and what most customers do after punching in the access hole is to tear open the card so that the contents can then be dropped out of the package. Hence a conventional blister card package cannot be used to dispense one item at a time, for once the package is opened, it ceases to have utility and is therefore discarded.

SUMMARY OF INVENTION

In view of the foregoing, it is the main object of this invention to provide a convertible blister-card package which in its storage mode acts to store a stack of cylindrical articles, and in its display mode acts to display these articles in an upright position, the package in the display mode also functioning as a one-at-a-time dispenser for the articles.

A significant advantage of a convertible package in accordance with the invention is that the same package may be used to ship and store the merchandise and as a counter display and dispenser therefor, so that no need exists to transfer the articles from shipping containers to a counter display device.

More particularly, it is an object of this invention to provide a package of the above-noted type in which the card for the blister-card package also includes a section hinged thereto which is capable of forming an easel to support the package in an upright display position.

Also an object of the invention is to provide a low-cost durable convertible blister-card package which may be efficiently mass produced.

SUMMARY OF INVENTION

In view of the foregoing, it is the main object of this invention to provide a convertible blister-card package which in its storage mode acts to store a stack of cylindrical articles, and in its display mode acts to display these articles in an upright position, the package in the display mode also functioning as a one-at-a-time dispenser.

A significant advantage of a convertible package in accordance with the invention is that the same package may be used to ship and store the merchandise and as a counter display therefor, so that no need exists to transfer the articles from shipping containers to a counter display device.

More particularly, it is an object of this invention to provide a package of the above-noted type in which the card for the blister-card package also includes a minor section hinged thereto which is capable of forming an easel to support the package in an upright display position.

Also an object of the invention is to provide a low-cost durable convertible blister-card package which may be efficiently mass produced.

Briefly stated, these objects are attained in a package having a card provided with a major section covered by a transparent dome to define a rectangular container for housing a stack of cylindrical articles, an open box being seated in the lower end of the container to receive the lowermost article in the stack.

The box is formed by a base, a pair of side walls and a relatively high rear wall which is free of the side walls and normally lies against the card. The rear wall is hinged from the card, whereby the box may be pulled out through an access opening in the dome to cause the rear wall to swing out to assume a position in which it is coplanar with the box to define a chute for dispensing the articles.

OUTLINE OF DRAWINGS

For a better understanding of the invention as well as other objects and further features thereof, reference is made to the following detailed description to be read in conjunction with the accompanying drawings, wherein:

FIG. 1 is a perspective view of a first embodiment of a convertible blister-card package in accordance with the invention, the package being shown in its storage mode as seen from the front;

FIG. 2 is a view of the same package in its storage mode as seen from the rear;

FIG. 3 illustrates the lower portion of the package in its display mode as seen from the rear;

FIG. 4 is a perspective view of the blank from which the dispenser box included in the package is formed;

FIG. 13 is similar to FIG. 12, but with a modified chute;

DESCRIPTION OF INVENTION

Figure 5:
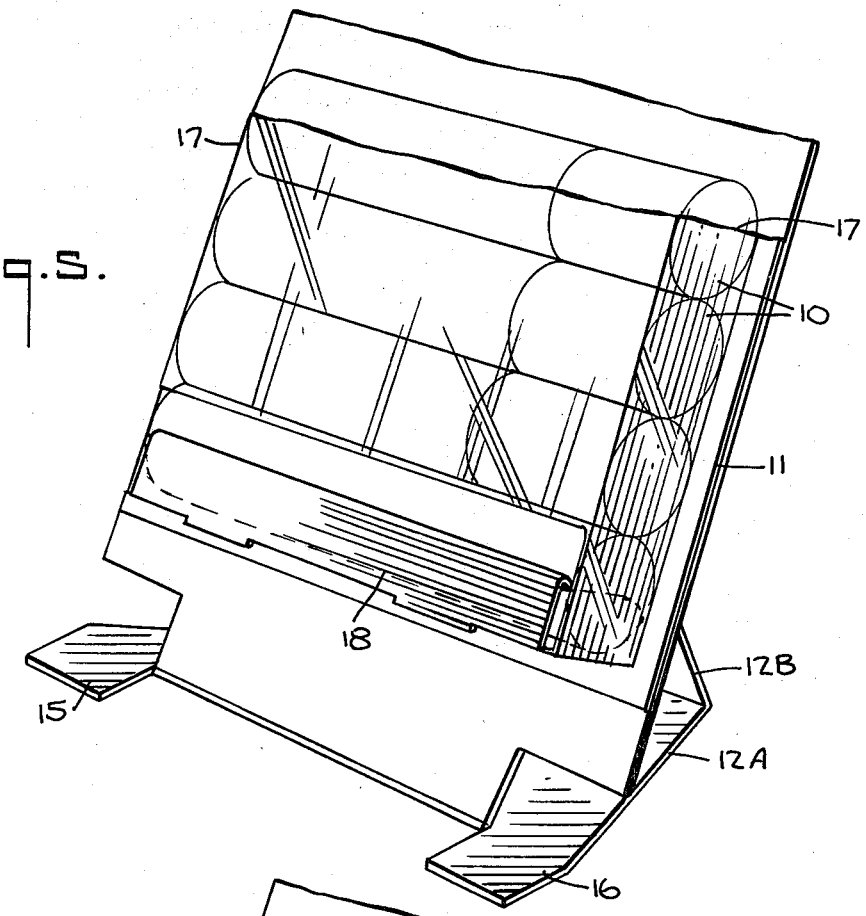
FIG. 5 is a front view of the lower portion of the package in its display mode.
Figure 6:
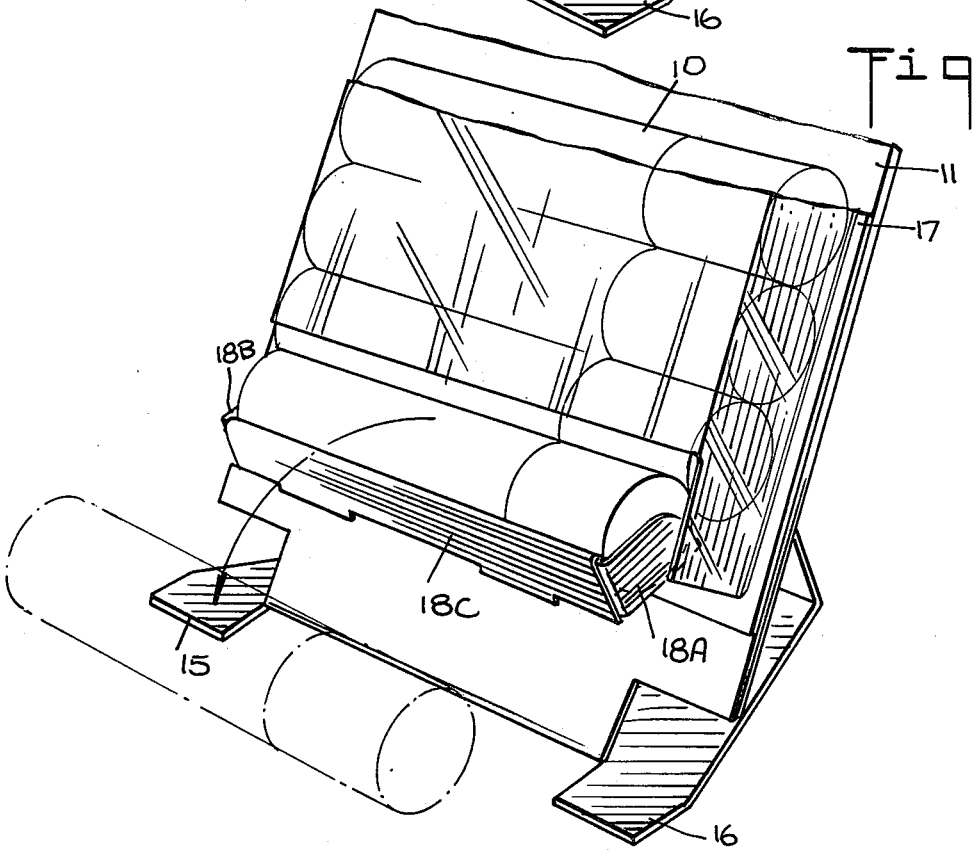
FIG. 6 illustrates the package in the display mode when it is operative to dispense cylindrical items of merchandise.

Storage Mode (first embodiment):

Referring now to FIGS. 1 to 2, there is shown a blister-card package in accordance with the invention in the storage mode in which it serves to store a stack of articles 10 having a cylindrical or roll form. The articles may be lipstick containers, penlight batteries or any other item of merchandise which is in roll form. The package in this mode may be used to ship the articles.

The package includes a card formed of cardboard or other suitable material, the card having a rectangular major upper section 11 and a lower minor section 12 of trapezoidal shape hinged to the lower end of the upper section. In this storage mode, the minor section is folded behind the major section and lies flat thereagainst, as shown in FIG. 2. The junction of the two sections on either side of hinge line 20 includes a pair of shoulders 13 and 14 to define a pair of feet 15 and 16.

Articles 10 are housed in a rectangular container formed by a transparent dome 17 of thermoplastic material whose peripheral skirt 17A is sealed to major section 11. The lowermost article 10A in the stack thereof is received within an open box 18 which, as will be explained later in greater detail, may be pulled out through an opening 19 in the bottom of dome 17 to define a chute from which the articles may be withdrawn one-at-a-time. In practice, opening 19 may be covered with a removable seal in the form of a plastic tape.

Dome 17 is shorter than major section 11 so that the exposed area on the card above the dome may be used for identifying and advertising the contents of the package.

Display Mode (first embodiment):

As best seen in FIG. 3, minor section 12 is provided with a crease line 21 which divides this section into sub-sections 12A and 12B. These sub-sections may be folded to assume a V-shaped easel formation behind major section 11 to support the package in an upright position for display purposes, as shown in FIG. 5. The free end of minor section 12 is provided with a latching slot 22 to receive the tongue 23 of a wall extension 24 passing through a slot 25 in major section 11, thereby holding the easel in place.

Tongue 23 and wall extension 24 are components of open dispenser box 18 which is formed by a single blank of cardboard material, as shown in FIG. 4. Box 18 is provided with side walls 18A and 18B, and a front wall 18C, all of the same height, the front wall having an outer panel 18C′ and an inner panel 18C″ which folds over right angle tabs 18A′ and 18B′ secured to the side walls. Rear wall 18D of the open dispenser box is hinged from the rear of base 18E. The rear wall is free of the side walls and extends thereabove, the rear wall having the extension 24 which passes through slot 25 in major section 11 (see also FIGS. 7 and 8).

Figure 8:
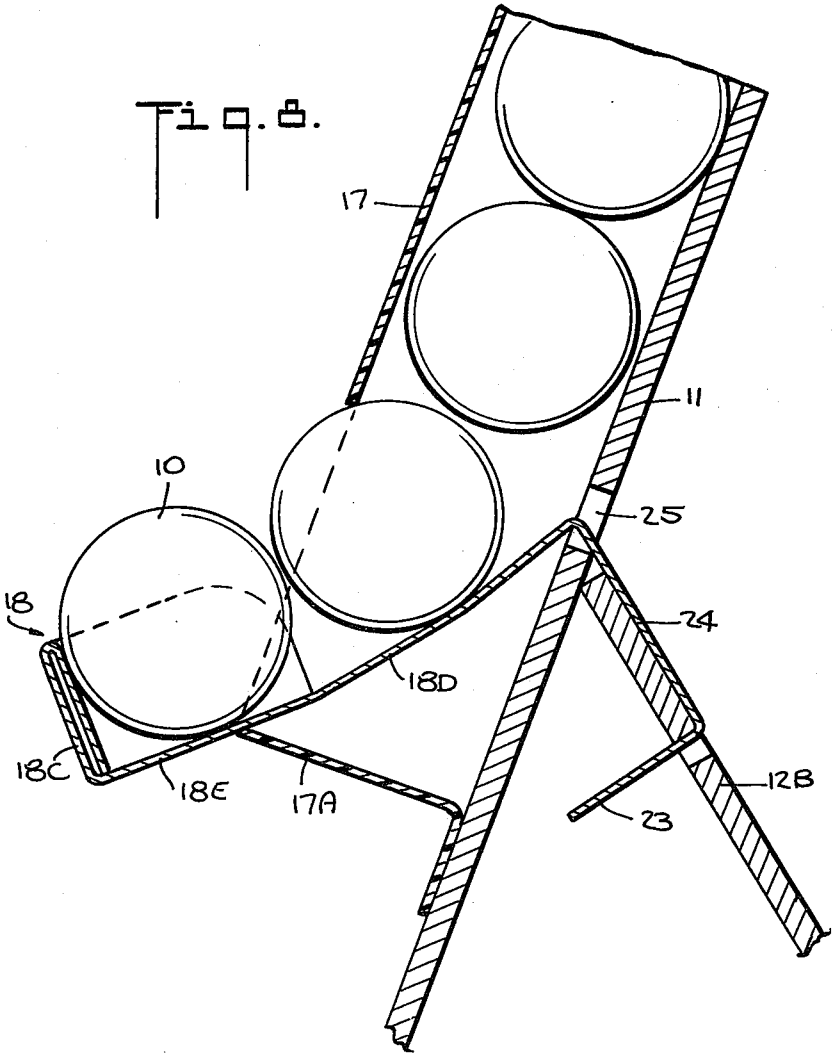
FIG. 8 is a sectional view of the package in the display mode with the dispenser box in its active state.
Figure 7:
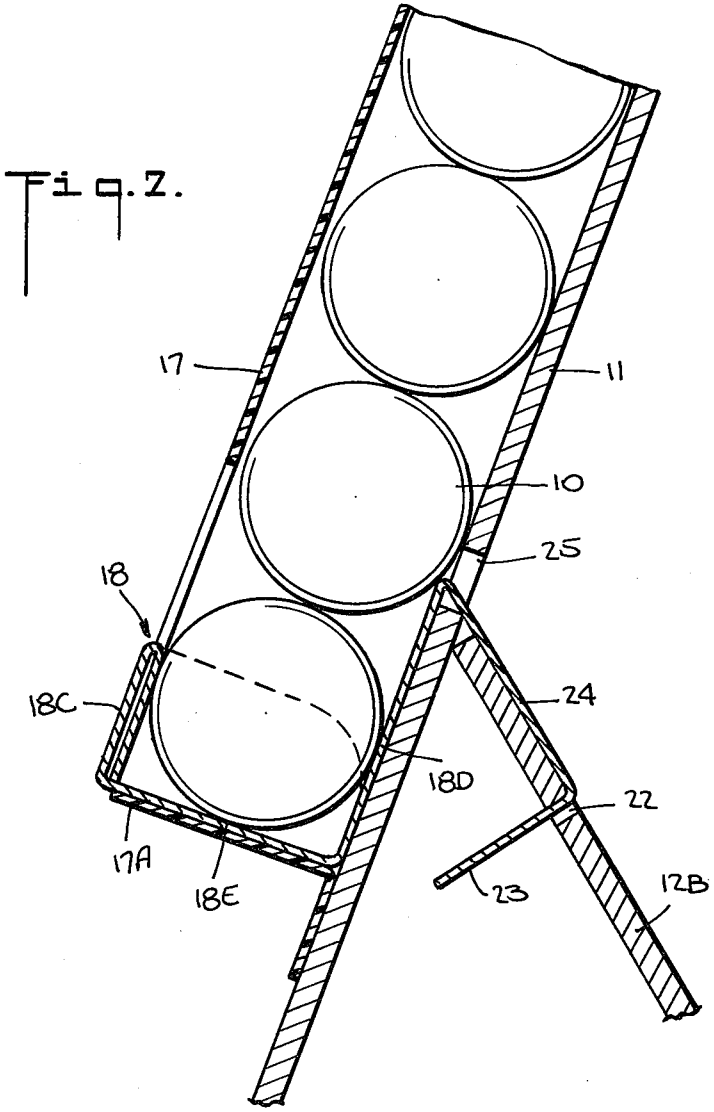
FIG. 7 is a sectional view of the package in the display mode with the dispenser box in its inactive state.

When box 18 is seated within the article container, rear wall 18D thereof lies against major section 11 of the card, as shown in FIG. 7, and base 18E of the box rests on the lower end 17A of the dome. To render the display operative to dispense articles, box 18 is pulled out of opening 19 in the some, as shown in FIG. 8, as a result of which rear wall 18D swings out from major section 11 to assume a position substantially co-planar with base 18E, which now is inclined and rests on the front edge of dome end 17A.

The box in this activated state functions as a chute wherein articles 10 roll down the ramp formed by base 18E and rear wall 18D. As each article is withdrawn from the mouth of the chute, the next article in the stack rolls down to take its place until the container is exhausted. To render the chute inactive, one simply pushes the box back into the container.

Second Embodiment:

Referring now to FIGS. 9 to 12, a blister card package is shown for housing and dispensing a stack of cylindrical articles 27 within a rectangular container formed by a card 28 and a transparent dome 29 secured thereto.

Figure 9:
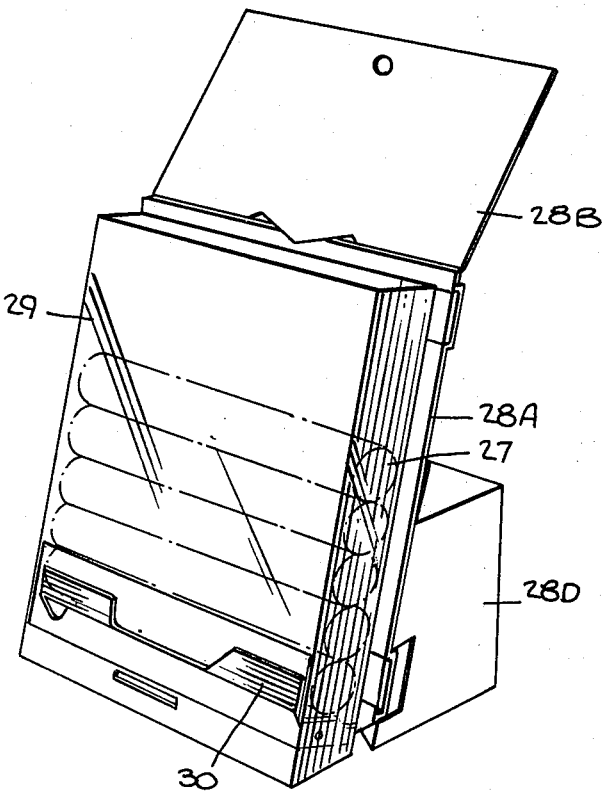
FIG. 9 is a perspective view of a second embodiment, the package being shown in the storage mode as seen from the front.
Figure 10:
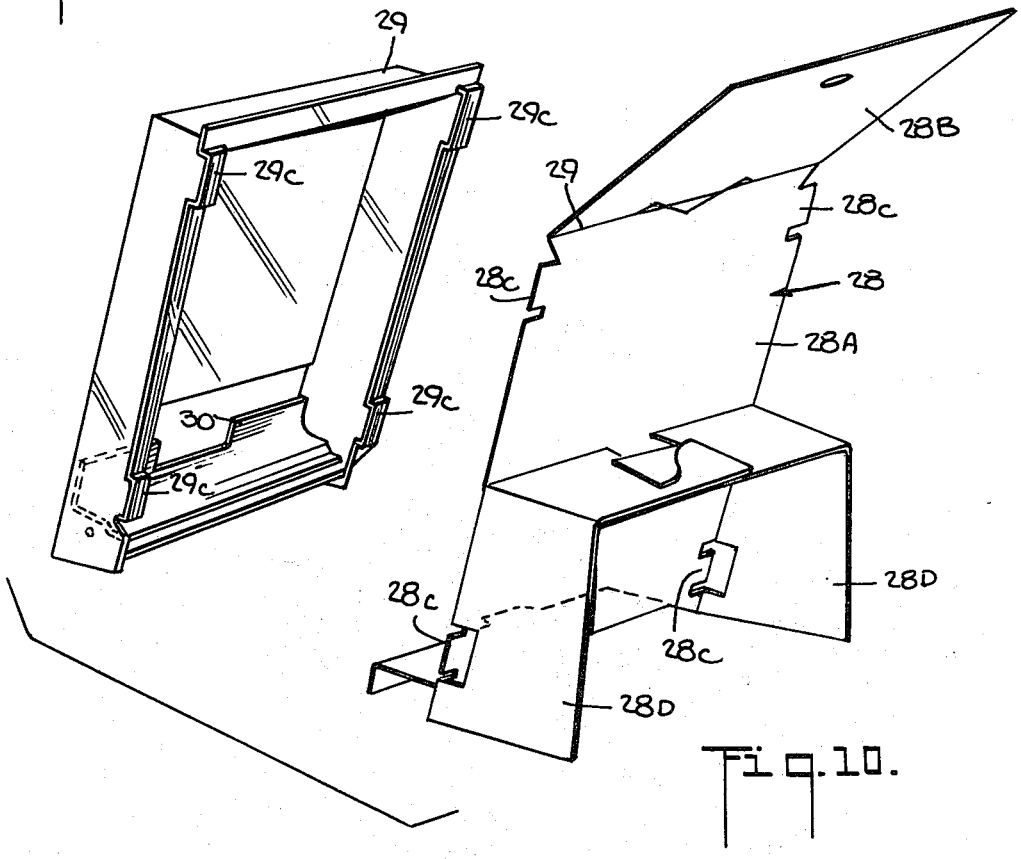
FIG. 10 is an exploded view of the second embodiment.
Figure 11:
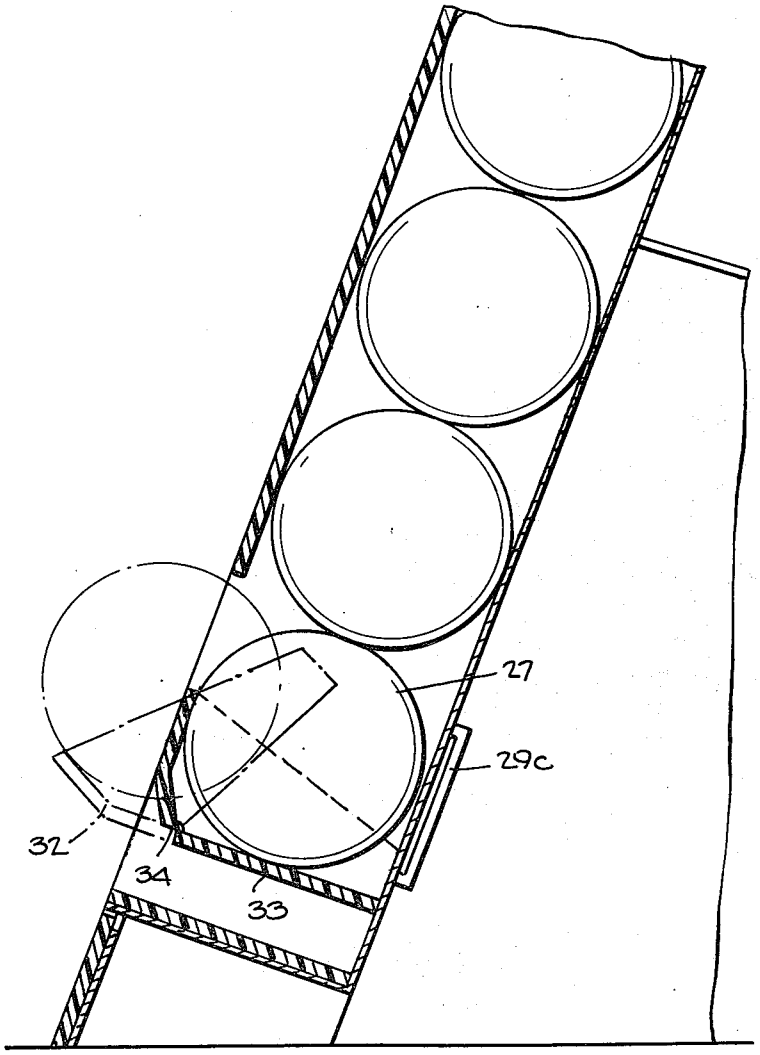

As best seen in FIG. 10, card 28 is formed from a single sheet of stiff cardboard or similar material that is divided by a fold-line 29 into a major section 28A and an upper minor section 28B. In the storage mode shown in FIG. 11, minor section 28B is folded behind the major section, whereas in the display mode illustrated in FIG. 9, the minor section 28B is raised above the major section 28A to provide a sign board identifying the product.

Figure 11:
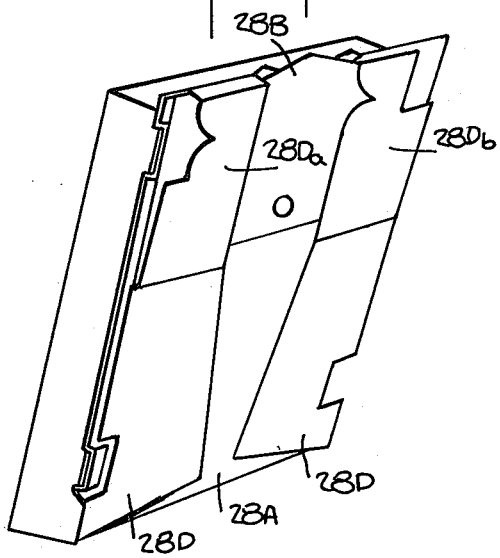
FIG. 11 shows, in perspective, the package in its collapsed state.

Major section 28A is provided adjacent its four corners with di-cut tabs 28*c* which are insertable into complementary loops 29*c* at the corners of dome 29, thereby retaining the dome. Major section 28A includes a pair of lateral wings 28D which in the storage mode shown in FIG. 11 are folded behind the major section against the folded-down minor section 28B to form a compact package.

When wings 28D are folded out in the display mode, as shown in FIGS. 9 and 10, and the upper sections $28D_a$ and $28D_b$ thereof are arched toward each other and interlocked, the resultant easel serves to support the package in an upright display position.

Figure 12:
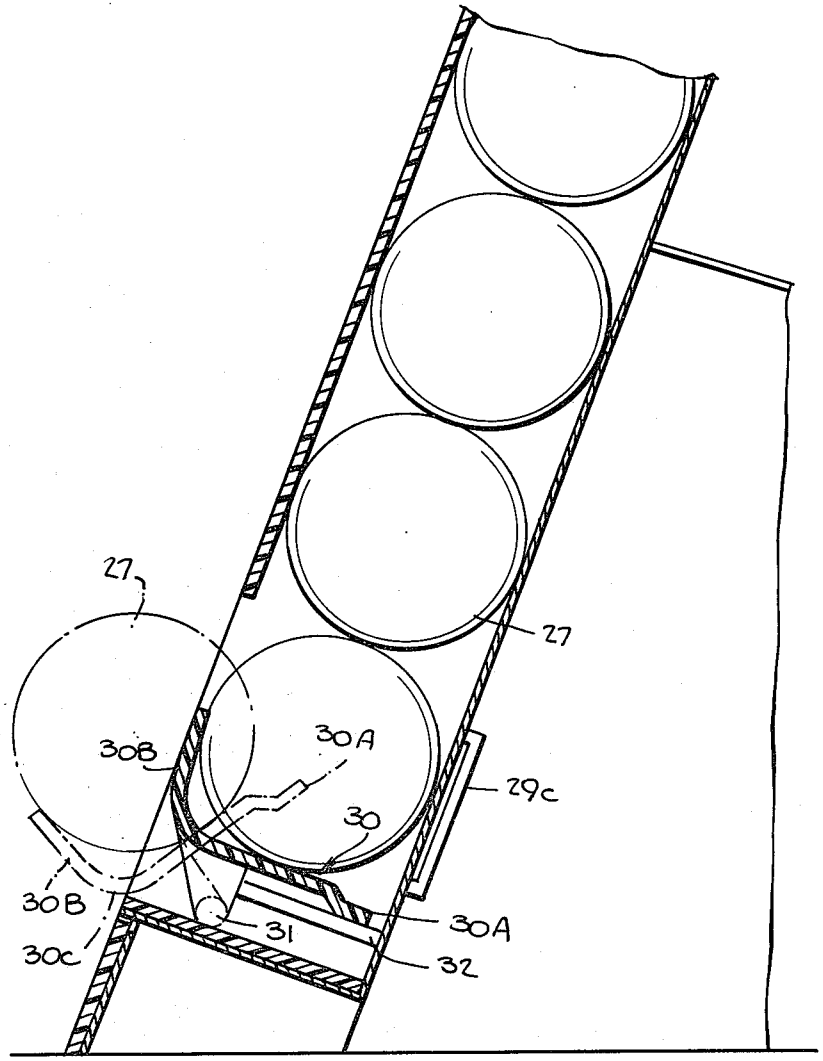
FIG. 12 is a longitudinal section through the package illustrating the operation of the dispensing chute.

As best seen in FIGS. 9 and 12, the lower end of dome 29 is provided with an access opening within which is seated a dispenser chute 30 provided with a pivot 31, the chute receiving the lowermost roll 27 stored in the container. Chute 30 is provided with a base wall 30A which in the storage mode rests on a side ledge 32 in the dome and a front wall 30B which normally confines roll 27 within the container. But when the chute is swung out on its pivot 31, as shown in dotted lines in FIG. 12, roll 27 is then brought outside of the container and rests in the trough 30C defined by front wall 30B and base wall 30A, thereby making it possible to remove the roll.

When a roll is removed and the chute is released, the next roll in the stack will drop and strike the then upwardly-inclined base wall 30A, causing the chute to retract in readiness for the next withdrawal of a roll.

Instead of a pivoted chute, as shown in FIG. 12, one may provide a chute 32, as shown in FIG. 13, which is joined to a fixed base wall 33 by a living hinge 34. Thus chute 32 serves in the storage mode to confine roll 27 to the container, but when manually pulled out, the roll may be withdrawn and the next roll in the stack then falls and serves to retract the chute.

Figure 15:
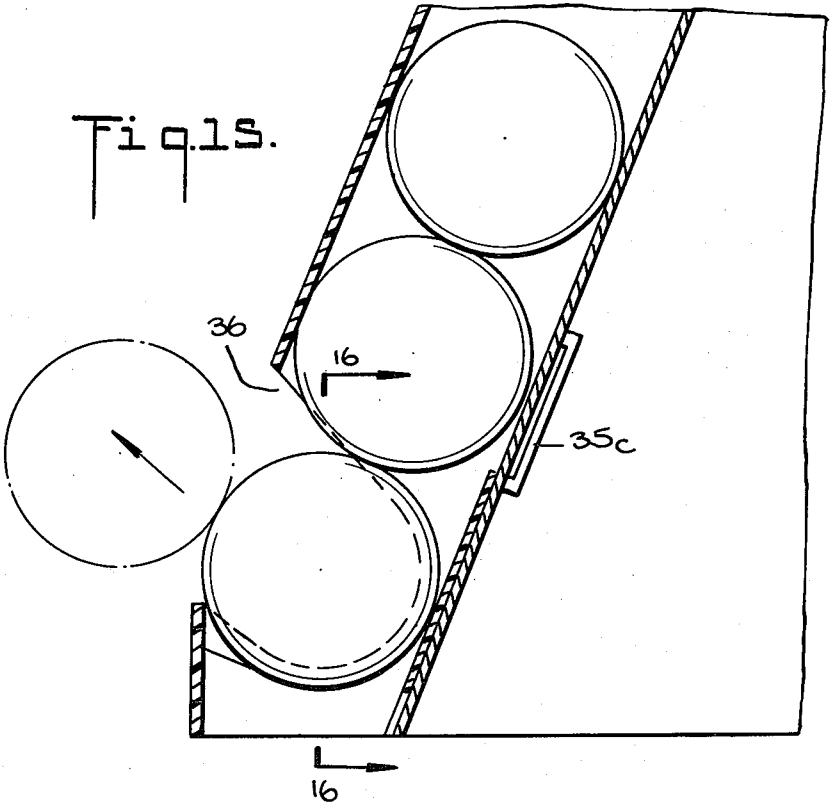
FIG. 15 is a longitudinal section of the package.
Figure 16:
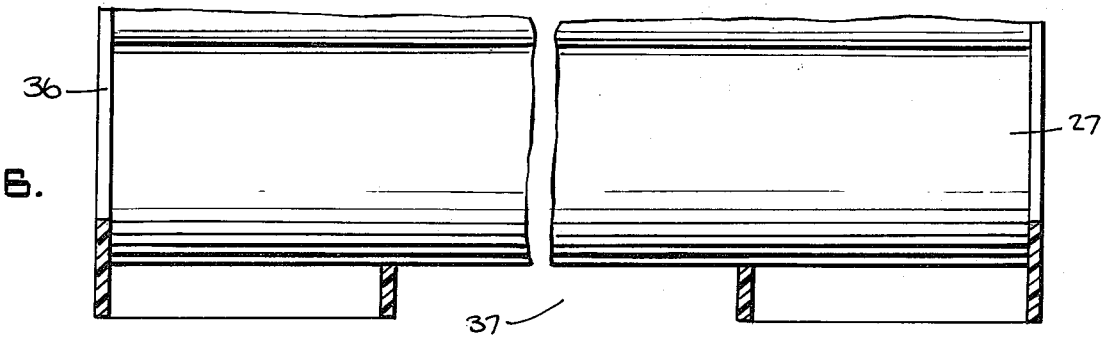
FIG. 16 is a transverse section taken in the plane of line 16—16 in FIG. 15.
Figure 14:
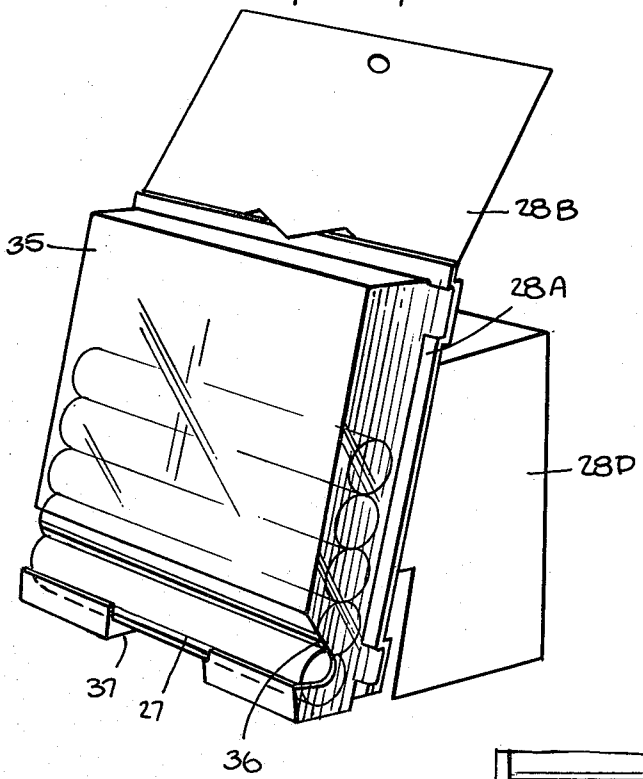
FIG. 14 is a perspective of a third embodiment.

Third Embodiment:

In the blister package shown in FIGS. 14, 15 and 16, card 28 is identical to card 28 in the second embodiment and is provided with tabs insertable in loops 35c formed in a dome 35 secured to the major section 28A of the card.

However, in this instance, no chute is provided, for rolls 27 are withdrawn from an access opening 36 adjacent the lower end of dome 35. To facilitate withdrawal, the lower end of the dome is provided with a breach 37, making it possible for one to place a finger under the roll 27 to be withdrawn.

While there have been shown and described preferred embodiments of a convertible blister-card package in accordance with the invention, it will be appreciated that many changes and modifications may be made therein without, however, departing from the essential spirit thereof.

I claim:

1. A convertible blister-card package for housing, displaying and dispensing articles having a roll form, said articles all having the same length and diameter, said package comprising:

A. a card having a major section covered by a transparent dome to define therewith a rectangular container whose width is substantially equal to the length of the articles for housing a stack of said articles, said dome having an access opening at the lower end thereof whose height is greater than the diameter of one of said articles and less than twice said diameter:

B. an open box seated in the lower end of said container to receive the lowermost article in said stack, said box having a base, a pair of side walls and a relatively high rear wall which is free of the side walls and normally lies against said card, said rear wall being hinged from said card whereby said box may be pulled out through said access opening to cause said rear wall to swing out from said card to assume an inclined position in which it is substantially co-planar with the base to define a chute for dispensing said articles, at which pulled-out position the lowermost article is removable from said box and the article directly thereabove which lies on said inclined rear wall is trapped within the access opening.

2. A package as set forth in claim 1, wherein said dome is provided with a peripheral skirt that is bonded to said card.

3. A package as set forth in claim 1, wherein said card further includes a minor section hinged from the lower end of said major section, said minor section being foldable into two subsections to form a V-shaped easel behind said major section for supporting the package in an upright position.

4. A package as set forth in claim 1, wherein said dome is shorter than said major section to provide a free zone above said container wherein said articles may be identified.

5. A package as set forth in claim 1, wherein said rear wall is provided with an extension which passes through a pivot slot in said card whereby said rear wall is hinged therefrom.

6. A package as set forth in claim 5, wherein said extension is provided with a tongue which is insertable in a latching slot in said minor section to maintain said easel.

7. A package as set forth in claim 1, wherein said box is formed from a one-piece blank.

* * * * *